US007291961B2

(12) United States Patent
Suzuki et al.

(10) Patent No.: US 7,291,961 B2
(45) Date of Patent: Nov. 6, 2007

(54) SPARK PLUG HAVING A SPECIFIC STRUCTURE OF NOBLE METAL TIP ON GROUND ELECTRODE

(75) Inventors: Akira Suzuki, Kasugai (JP); Wataru Matsutani, Nagoya (JP)

(73) Assignee: NGK Spark Plug Co., Ltd., Aichi (JP)

( * ) Notice: Subject to any disclaimer, the term of this patent is extended or adjusted under 35 U.S.C. 154(b) by 490 days.

(21) Appl. No.: 10/948,465

(22) Filed: Sep. 24, 2004

(65) Prior Publication Data

US 2005/0077807 A1 Apr. 14, 2005
US 2005/0242695 A9 Nov. 3, 2005

Related U.S. Application Data

(60) Provisional application No. 60/603,270, filed on Aug. 23, 2004.

(30) Foreign Application Priority Data

Sep. 27, 2003 (JP) ..... P. 2003-373436

(51) Int. Cl.
*H01T 13/20* (2006.01)

(52) U.S. Cl. ..... 313/141; 313/142; 313/143; 123/169 EL

(58) Field of Classification Search ..... 313/141–143; 123/169 EL
See application file for complete search history.

(56) References Cited

U.S. PATENT DOCUMENTS

| | | | |
|---|---|---|---|
| 2002/0038992 | A1 | 4/2002 | Morita et al. |
| 2002/0067111 | A1 | 6/2002 | Shibata et al. |
| 2002/0105254 | A1 | 8/2002 | Hori et al. |
| 2002/0121849 | A1 | 9/2002 | Kanao et al. |
| 2003/0155849 | A1 | 8/2003 | Hori |
| 2003/0193282 | A1 | 10/2003 | Shibata et al. |
| 2004/0041506 | A1 | 3/2004 | Teramura et al. |
| 2004/0061421 | A1 | 4/2004 | Morita et al. |

*Primary Examiner*—Joseph Williams
*Assistant Examiner*—Bumsuk Won
(74) *Attorney, Agent, or Firm*—Sughrue Mion Pllc.

(57) ABSTRACT

A method for producing a spark plug, the spark plug including: a center electrode; an insulator which holds the center electrode therein in a state where a tip end portion of the center electrode protrudes therefrom; a metal shell which holds the insulator therein; a ground electrode which is fixed to the metal shell, the ground electrode having an inner side face having a width that is smaller as it advances toward a tip end side, in a portion of the inner side face positioned between a pair of tapered faces; and a discharge portion which is bonded to the inner side face of the ground electrode by laser welding so as to attain a diameter of 0.8 mm or less and a height of 0.5 mm or more, a discharge gap being formed between the discharge portion and the tip end portion of said center electrode, the method including: forming the tapered faces before the discharge portion is laser-welded to the inner side face.

7 Claims, 6 Drawing Sheets

FIG. 4

| DISTANCE L (mm) | 0 | 0.1 | 0.2 | 0.3 | 0.4 | 0.5 | 0.6 | 0.7 | 0.8 | 0.9 | 1.0 |
|---|---|---|---|---|---|---|---|---|---|---|---|
| OXIDATION RATE | × | ○ | ○ | ◎ | ◎ | ◎ | ○ | ○ | ○ | × | × |

◎ : OXIDATION RATE IS SMALLER THAN 30%
○ : OXIDATION RATE IS 30 TO 50%
× : OXIDATION RATE IS LARGER THAN 50%

SPARK PLUG HAVING A SPECIFIC STRUCTURE OF NOBLE METAL TIP ON GROUND ELECTRODE

CROSS REFERENCE TO RELATED APPLICATIONS

This application claims benefit from U.S. Provisional Application No. 60/603,270 filed Aug. 23, 2004, incorporated herein by reference.

BACKGROUND OF THE INVENTION

1. Field of the Invention

The present invention relates to a method of producing a spark plug, and also to a spark plug.

2. Description of the Related Art

JP-A-2002-237365 discloses in FIG. 26 a ground electrode in which a noble metal tip is laser-welded to an inner side face that is formed into a tapered shape as it advances toward the tip end side, so as to protrude from the inner side face.

SUMMARY OF THE INVENTION

When the ground electrode is formed into a tapered shape after the noble metal tip is laser welded, impact occurring during formation of the tapered shape may cause a crack or the like in a molten bond formed by the welding. Particularly, this phenomenon has a high tendency to occur when laser welding is conducted in a state where, in order to improve ignitability, a noble metal tip having a small diameter of 0.8 mm or less protrudes by 0.5 mm or more from the inner side face of the ground electrode.

The present invention has been achieved in view of the above-described problem. It is therefore an object of the present invention to provide a method of producing a spark plug in which the reliability of a molten bond can be improved.

The above object has been achieved by providing a method of producing a spark plug having: a center electrode; an insulator which holds the center electrode therein in a state where a tip end portion of the center electrode protrudes therefrom; a metal shell which holds the insulator therein; a ground electrode which is fixed to the metal shell, the ground electrode having an inner side face (a face opposed to the center electrode) having a width that is smaller as it advances toward a tip end side, in a portion of the inner side face positioned between a pair of tapered faces; and a discharge portion which is bonded to the inner side face of the ground electrode by laser welding to attain a diameter of 0.8 mm or less and a height of 0.5 mm or more, a discharge gap being formed between the discharge portion and the tip end portion of the center electrode, which method comprises forming the tapered faces before the discharge portion is laser-welded to the inner side face.

In the case of a diameter of 0.8 mm or less in which a molten bond has a small sectional area, the weld strength is easily reduced. In the case where the protrusion distance of the noble metal tip is 0.5 mm or more, stress due to vibration in the process of forming the tapered faces tends to be easily concentrated in the molten bond. By contrast, when a spark plug is produced by the method of the invention, it is possible to avoid this problem.

Preferably, the laser welding is conducted after the noble metal tip primarily containing a noble metal is positioned such that the minimum distance between either of the tapered faces and the tip end face of the ground electrode, and the noble metal tip is set to 0.1 mm or more and 0.8 mm or less.

In the laser welding of the noble metal tip, when the irradiation angle of a laser beam is about ±20° with respect to an extension face of the inner side face of the ground electrode to which the discharge portion is to be bonded, the laser welding can be stably conducted. During a laser welding process, although both the discharge portion and the ground electrode must be simultaneously melted, the laser beam can be focused within a range of about 0.8 mm or less. Nickel which is the principal component of the ground electrode base member is more easily melted than the noble metal tip primarily containing a noble metal. Because of these reasons, when laser welding is conducted after positioning the discharge portion in accordance with the invention as described above, the laser welding can be stably conducted.

In order to prevent spark discharge at the molten bond, preferably, the distance between the tip end face of the noble metal tip and the molten bond is increased. Specifically, the height (t) of the unmelted portion of the noble metal tip is set to 0.3 mm or more. In this manner, a spark plug in which the height of the unmelted portion protruding from the molten bond is large tends to be easily broken. This is because of stress concentration due to vibrations in the process of forming the tapered faces. When the laser welding is conducted after the tapered faces are formed, it is possible to avoid stress concentration on the molten bond occurring during formation of the tapered faces.

The height (t) of the unmelted portion is defined by the minimum distance between the tip end face of the noble metal tip and the molten bond.

Preferably, the molten bond is formed to extend from the inner side face to the tapered faces, and has a curved shape at a corner formed between the inner side face and the tapered faces. When the edges formed at a corner between the inner side face and the tapered faces are angular, the electric field is easily concentrated in these portions. As a result, in such a structure, spark discharge at the molten bond easily occurs, and hence the molten bond is susceptible to damage. By contrast, when the edges formed by the inner side face of the ground electrode and the tapered faces are melted during the laser welding and the molten bond is formed into a curved shape at a corner formed between the inner side face and the tapered faces, damage of the molten bond due to concentration of an electric field can be effectively prevented.

Preferably, a spark plug in which the molten bond can be effectively prevented from damage both during a production process and after the production process is a spark plug having: an insulator which holds the center electrode therein in a state where a tip end portion of the center electrode protrudes therefrom; a metal shell which holds the insulator therein; a ground electrode which is fixed to the metal shell, the ground electrode having an inner side face having a width that is smaller as it advances toward a tip end side, in a portion of the inner side face positioned between a pair of tapered faces; and a discharge portion in which a noble metal tip is bonded to the inner side face of the ground electrode by laser welding to attain a diameter of 0.8 mm or less and a height of 0.5 mm or more, a discharge gap being formed between the discharge portion and the tip end portion of the center electrode, wherein a molten bond in which the noble metal tip and the ground electrode are melted together is formed to extend from the inner side face to the tapered faces, the molten bond having a curved shape at a corner formed between the inner side face and the tapered faces.

Since the spark plug has a discharge portion in which the diameter is 0.8 mm or less and the height is 0.5 mm or more, the electric field strength is easily concentrated at the tip end of the discharge portion. Moreover, the molten bond is formed so as to extend from the inner side face to the tapered faces, and a corner formed between the inner side face and the tapered faces has a rounded shape. Therefore, concentration of electric field strength hardly occurs in these portions. Because of a synergistic effect due to these two structural features, the electric field strength is concentrated at the tip end of the discharge portion, and hence stable spark discharge is enabled at a low discharge voltage. The spark plug is formed by laser-welding the noble metal tip after the tapered faces are formed. Therefore, the molten bond is not broken by vibrations in the process of forming the tapered faces.

Preferred examples of a material of the noble metal tip are Pt alloys such as Pt-20 wt % Ni, Pt-20 wt % Rh, and Pt-20 wt % Rh-5 wt % Ni, and Ir alloys such as Ir-5 wt % Pt, Ir-20 wt % Rh, Ir-5 wt % Pt-1 wt % Rh-1 wt % Ni, and Ir-11 wt % Ru-8 wt % Rh-1 wt % Ni. The material is not restricted to these examples, and other known noble metal tips can be suitably applied.

BRIEF DESCRIPTION OF THE DRAWINGS

FIG. 4 shows test results obtained in evaluating weldability in the case where the minimum distance L is set to have a value of 0 to 1.0 mm.

DESCRIPTION OF REFERENCE NUMERALS AND SYMBOLS

Figure 1:
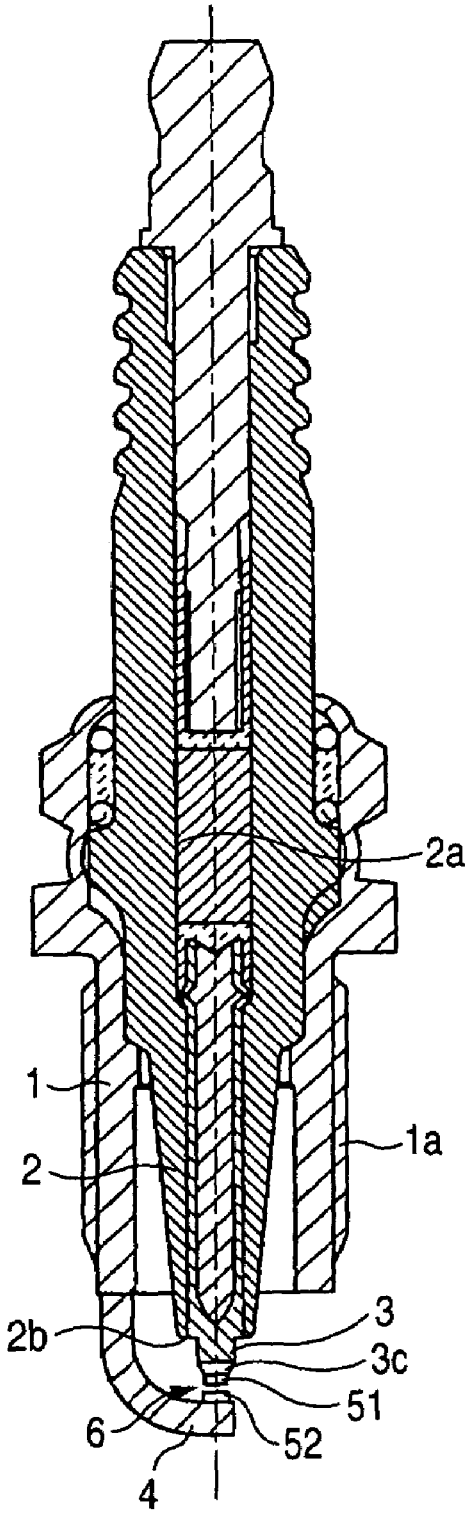
FIG. 1 is a front view showing an embodiment of a spark plug which is produced by the method of the present invention.

1 metal shell
1*a* thread portion
2 insulator
3 center electrode
4 ground electrode
4*a* inner side face
4*b* tapered face
4*c* tip end face
51 tip end portion
52 discharge portion
52*a* noble metal tip
53 molten bond
6 discharge gap

DETAILED DESCRIPTION OF THE INVENTION

Hereinafter, a method of producing a spark plug which is a preferred embodiment of the invention will be described. However, the present invention should not be construed as being limited thereto.

FIG. 1 shows a spark plug which is produced by the production method of the embodiment. As shown in FIG. 1, the spark plug has a cylindrical metal shell 1. The metal shell 1 comprises a thread portion 1*a* for fixing the spark plug to an engine block which is not shown. An insulator 2 which is made of alumina ceramic ($Al_2O_3$) or the like is fixed to the inside of the metal shell 1. A center electrode 3 is fixed to an axial hole 2*a* of the insulator 2. A tip end portion 2*b* of the insulator 2 is exposed from the metal shell 1.

The center electrode 3 is a columnar member in which a metal material having a high thermal conductivity, such as Cu is placed inside the electrode, and another metal material that has high thermal resistance and corrosion resistance, such as a nickel-base alloy consisting of INCONEL 600 (trademark), covers the outside of the metal material having a high thermal conductivity. A tip end portion 51 of the center electrode is exposed from the tip end portion 2*b* of the insulator 2. The tip end portion 51 is formed by a noble metal tip made of an iridium alloy. The tip end portion 51 is formed so as to have a circular shape in section. In consideration of the heat dissipation property of the tip end portion 51 and the flame quenching effect of the center electrode 3, for example, the tip end portion 51 has a diameter of 0.6 mm and a length of 0.8 mm.

The center electrode 3 has a small-diameter portion 3*c* at the tip end side, and has a straight portion at the tip end of the small-diameter portion 3*c*. A noble metal tip made of 95 wt % of iridium and 5 wt % of platinum is placed on the tip end of the straight portion, and then bonded by laser welding, thereby forming the tip end portion 51. The outer diameter of the straight portion is slightly larger than that of the noble metal tip. The laser welding is conducted at eight spots at an outer periphery of the noble metal tip which are arranged at intervals of 45° in a circumferential direction.

A ground electrode 4 is fixed by welding to one end of the metal shell 1. The ground electrode 4 is made of a metal material such as a nickel-base alloy consisting of INCONEL 600 (trademark), and has an inner side face (a face opposed to the center electrode) 4*a* having a width that is smaller as it advances toward the tip end side, in a portion of the inner side face positioned between a pair of tapered faces 4*b*. A noble metal tip 52*a* primarily containing a noble metal is bonded to the inner side face 4*a* by laser welding so as to protrude by about 0.8 mm from the inner side face 4*a*, thereby forming a discharge portion 52. A discharge gap 6 is formed by the discharge portion 52 and the tip end portion 51 of the center electrode 3. The discharge portion 52 has a circular section shape having a diameter of 0.7 mm, and is formed of an alloy of 80 wt % of platinum and 20 wt % of iridium. Usually, the ground electrode 4 is formed so as to have a width of about 2.2 to 2.8 mm, and the tip end face positioned between the pair of tapered faces is formed so as to have a width of about 0.6 to 1.2 mm. As used herein "primarily containing a noble metal" means that the content of a noble metal(s) is larger than 50 wt %.

The wear amount due to spark discharge tends to be larger at the tip end portion 51 of the center electrode 3 than at the discharge portion 52 of the ground electrode 4. The temperature of the ground electrode 4 tends to increase more rapidly than the temperature of the center electrode 3. In this embodiment, therefore, the tip end portion 51 is made of an iridium alloy having a higher wear resistance against spark discharge, and the discharge portion 52 is made of a platinum alloy in which oxidation and volatilization can be avoided even at a high temperature.

Next, a method of producing the spark plug will be specifically described with reference to FIG. 2. A substantially cylindrical metal shell 1' which has not yet been subjected to a threading process is formed by a process such as a cold extrusion process and a cutting process. In the metal shell 1', a tool engagement portion 1*d* having a hexagonal section shape is formed on one end side with respect to an axial middle portion 1*b*, and a thread forming portion 1*a*' which is substantially cylindrical, and in which the diameter is smaller than that of the center portion 1*b*, is formed on the other end side (see FIG. 2A).

Figure 2E:
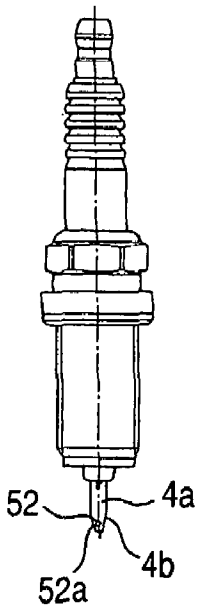
FIGS. 2A to 2E are views diagrammatically showing steps of producing the spark plug of the invention.
Figure 2D:
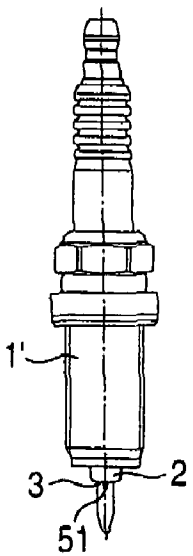
Figure 2C:
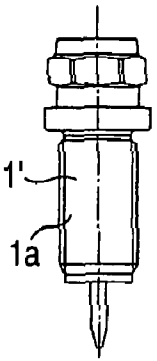
Figure 2B:
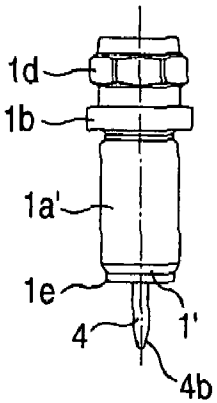
Figure 2A:
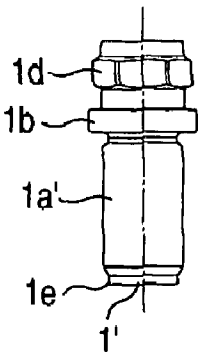

The ground electrode 4 having the tapered faces 4*b* formed at the tip end is resistance-welded to a tip end face 1*e* of the thread forming portion 1*a*' (see FIG. 2B). Then, a rolling process is applied to the thread forming portion 1*a*' of the metal shell 1' to form the thread portion 1*a* (FIG. 2C). Next, a surface treatment such as galvanizing is applied to the metal shell 1', and the insulator 2 holding the center electrode 3 to which the noble metal tip is welded to form the tip end portion 51 is attached to the metal shell 1' (FIG. 2D). The noble metal tip 52*a* is placed in a portion of the inner side face 4*a* which is positioned between the pair of tapered faces 4*b*, and in which the width is smaller than the original width of the ground electrode. The interface between the inner side face 4*a* and the noble metal tip 52*a* is irradiated with a laser beam in a substantially horizontal direction, thereby forming the discharge portion 52 in the ground electrode 4 (FIG. 2E).

In this embodiment, the ground electrode 4 in which the tapered faces are previously formed is resistance-welded to the ground electrode 4. Alternatively, the tapered faces may be formed after the resistance welding is conducted. Alternatively, the discharge portion 52 may be formed by provisionally welding the noble metal tip 52*a* on the side of the ground electrode to the inner side face 4*a* of the ground electrode 4 by resistance welding or the like, forming the tapered faces, and thereafter conducting laser welding. In other words, the tapered faces may be formed in the ground electrode 4 at any step so long as laser welding has not yet been conducted.

EXAMPLES

A preferred arrangement of the discharge portion 52 in the above-described embodiment of the invention will now be described with reference to FIGS. 3 to 5.

Figure 3:
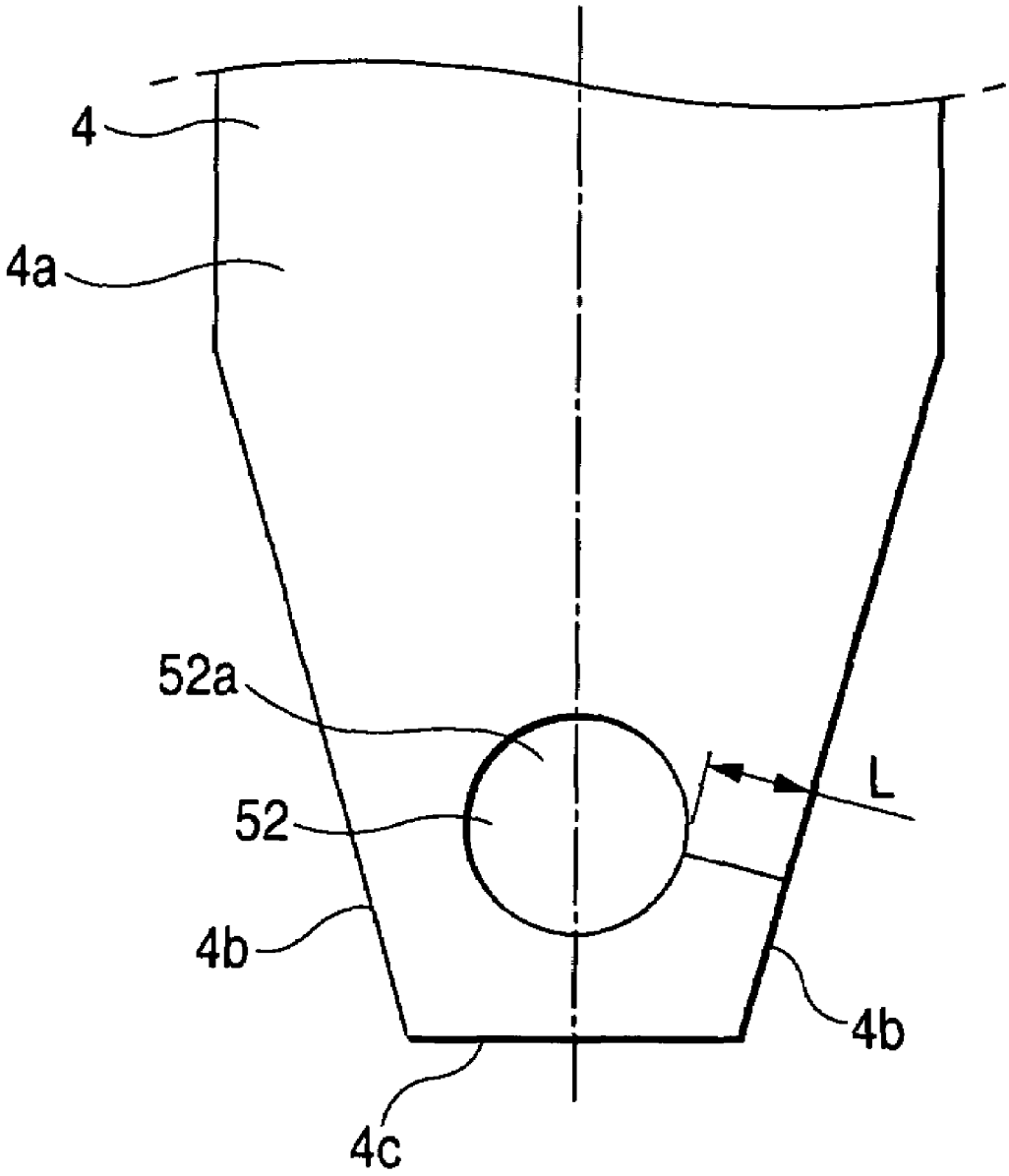
FIG. 3 is a diagram showing the minimum distance L between tapered faces and a tip end portion of a ground electrode, and a discharge portion.

FIG. 3 is a diagram showing positioning of the discharge portion 52 with respect to the inner side face 4*a* of the ground electrode 4, i.e., the minimum distance L between the tapered faces 4*b* and the tip end face 4*c* of the ground electrode 4, and the noble metal tip 52*a*. FIG. 4 shows test results obtained in evaluating weldability in the case where the minimum distance L is set to have a value of 0 to 1.0 mm. The weldability was evaluated in the following manner. A spark plug was repeatedly subjected to 1,000 cycles in each of which the tip end of the spark plug on the side of the spark discharge gap was heated by a gas burner for two minutes to 1,000° C. in the vicinity of the molten bond between the ground electrode 4 and the noble metal tip 52*a*, and then air cooled for one minute (corresponding to a travel distance of about 100,000 km in a durability test on an actual engine under usual traveling conditions). Then, the spark plug which had undergone the test was cut and polished in a plane passing through the center axis of the discharge portion 52, and the section was magnified and observed under a microscope. The length of an oxidized portion (oxidation length) at the interface between the noble metal tip 52*a* and the ground electrode 4 was measured in the observation field. The measured length of the oxidized portion was divided by the total length of the interface, and the division result was set as an oxidation rate. In a spark plug in which the oxidation rate was larger than 50% the weldability was judged not good (×), that in which the rate was 30 to 50% was judged to have good peel resistance (○), and that in which the rate was smaller than 30% was judged as being excellent (◎).

As shown in FIG. 4, satisfactory results were obtained when L was 0.1 to 0.8 mm, and the best results were obtained when L was 0.3 to 0.5 mm.

Figure 5A:
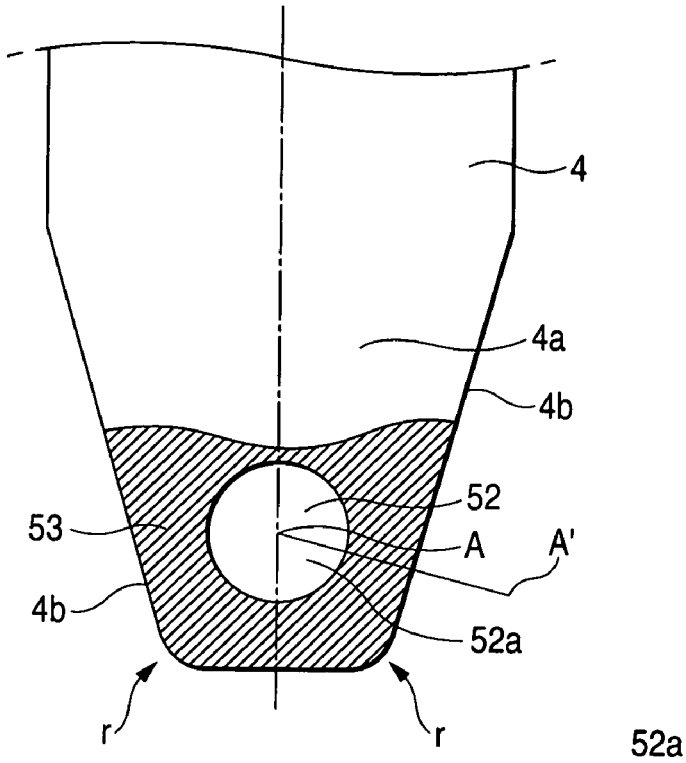
FIGS. 5A and 5B are diagrams showing a state after laser welding in the case where the discharge portion is positioned so as to attain the value of L at which a desirable result is obtained.
Figure 5B:
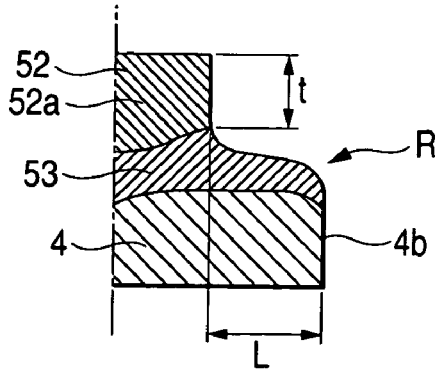

FIG. 5 is a diagram showing a state after laser welding in the case where the discharge portion 52 is formed by placing the noble metal tip 52*a* on the inner side face 4*a* of the ground electrode 4 so as to attain the value of L at which the best result is obtained. FIG. 5B is a partial sectional view taken along the line A-A' in FIG. 5A. As shown in FIG. 5B, a molten bond 53 is formed so as to extend from the inner side face 4*a* to the tapered faces 4*b*. The molten bond 53 has a curved shape which protrudes outward in a convex shape, and has a radius of curvature R, at a corner between the inner side face 4*a* and the tapered faces 4*b*. Preferably, the radius of curvature R is in the range of 0.3 mm to 1.0 mm (in the examples, about 0.4 mm).

In the noble metal tip 52*a*, a portion (unmelted portion) which is not melted by the laser welding has a height t of 0.45 mm. The minimum distance (the height t of the unmelted portion) between the tip end face of the noble metal tip 52*a* and the molten bond 53 is set to 0.3 mm or more. In the resulting structure, therefore, discharge at the molten bond hardly occurs.

Moreover, the noble metal tip 52*a* is laser-welded so as to satisfy a relationship of $t \geqq 0.78 \times S$ between the height (t) of the unmelted portion of the noble metal tip 52*a* and a horizontal sectional area S of the noble metal tip 52*a*.

With respect to a noble metal tip having a height of 0.8 mm and a tip diameter $\phi$ of 0.7 mm (the horizontal sectional area=about 0.385 $mm^2$), while changing the height (t) of an unmelted portion in the range of 0.1 mm to 0.55 mm, the relationship between t/S and the crack occurrence rate was evaluated in the case where tapered faces were formed after the noble metal tip was laser-welded. The results are shown in FIG. 6.

Figure 6:
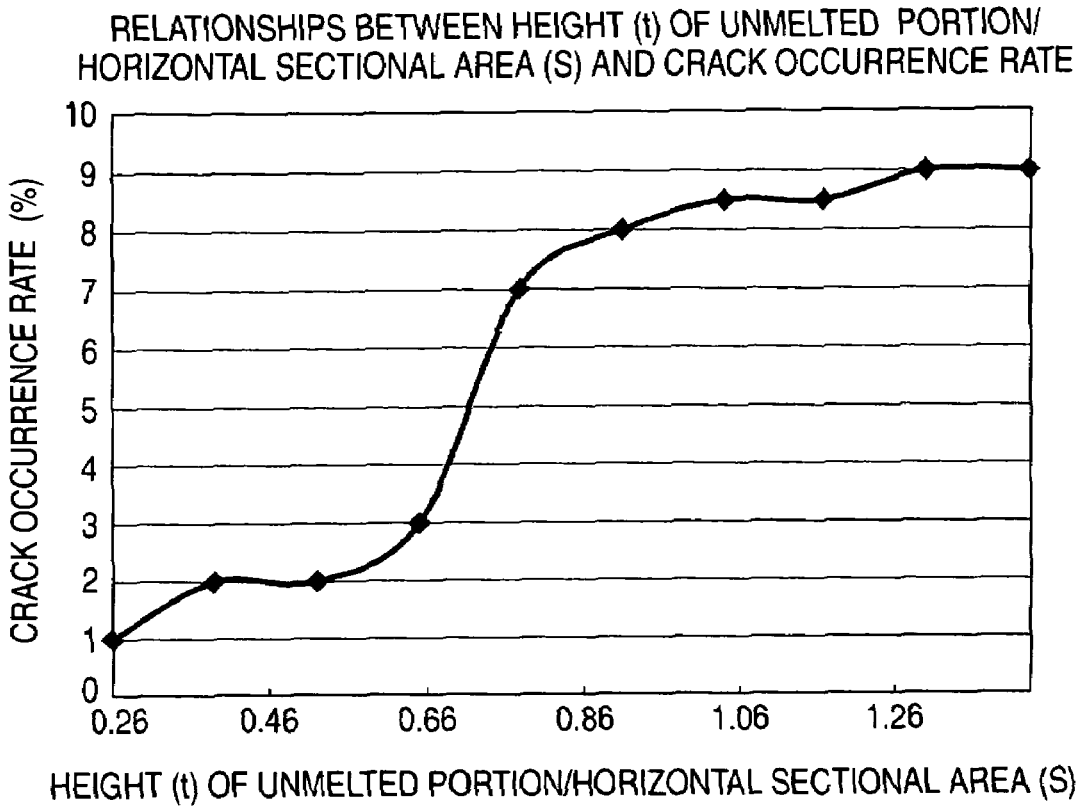
FIG. 6 shows the relationship between a ratio of the length (t) of an unmelted portion (straight portion) of a noble metal tip to a horizontal sectional area (S), and a crack occurrence rate after the tapered faces are processed.

FIG. 6 shows that when tapered faces are formed after a noble metal tip satisfying $t \geqq 0.78 \times S$ is laser-welded, the crack occurrence rate is high. By contrast, in the Examples, the noble metal tip is welded to the ground electrode in which the tapered faces are previously formed. Even in the case of a noble metal tip satisfying $t \geqq 0.78 \times S$, therefore, it is possible to prevent cracks from occurring.

In the Examples, as shown in FIG. 5A, the edges formed at a corner between the tapered faces 4*b* of the ground electrode and the tip end face 4*c* are melted by a laser beam to have a curved shape which protrudes outward in a convex shape, and which has a radius of curvature r. According to this configuration, the electric field strength can be further suppressed from concentrating at such edges as compared with the case where the edges formed by the tapered faces 4*b* of the ground electrode and the tip end face 4*c* are angular as shown in FIG. 3. Therefore, this configuration prevents the molten bond 53 from becoming damaged.

In FIG. 5A, as viewed from the tip end face of the noble metal tip 52*a*, a middle portion of the molten bond 53 on the side of the metal shell (the rear end side) has an inward recessed shape. Namely, this portion has a structure in which the width (the minimum distance between the outer peripheral edge of the molten bond 53 and the outer peripheral face of the noble metal tip 52*a*) is smaller than the width of another portion. The reason therefor is as follows. The front face of the noble metal tip on the side of the metal shell is hardly irradiated with a laser beam, because of obstruction by the metal shell. Therefore, the laser irradiation is conducted in an oblique direction. In the front face of the noble metal tip on the side of the metal shell, as a result, the width of the molten bond is smaller than that of another portion. Even in such a shape, in order to obtain sufficient bonding strength between the noble metal tip 52*a* and the ground electrode 4, preferably, a minimum width of 0.25 mm or more is ensured in the recessed portion.

It should further be apparent to those skilled in the art that various changes in form and detail of the invention as shown and described above may be made. It is intended that such changes be included within the spirit and scope of the claims appended hereto.

This application is based on Japanese Patent application JP 2003-373436, filed Sep. 27, 2003, the entire content of which is hereby incorporated by reference, the same as if set forth at length.

What is claimed is:

1. A spark plug comprising:

a center electrode having a tip end portion;

an insulator which holds said center electrode therein in a state where the tip end portion of said center electrode protrudes therefrom;

a metal shell which holds said insulator therein;

a ground electrode which is fixed to said metal shell, said ground electrode having an inner side face;

a discharge portion in which a noble metal tip is bonded to said inner side face of said ground electrode by laser welding, a discharge gap being formed between said discharge portion and said tip end portion of said center electrode; and a molten bond, in which said noble metal tip and said ground electrode are melted together, wherein an unmelted portion of said noble metal tip protrudes from said molten bond, and wherein said molten bond has a shape in which a middle portion on a side of said metal shell is inward recessed as viewed from a tip end face of said noble metal tip, and a minimum distance between an outer peripheral edge of said molten bond in said recessed portion and an outer peripheral face of said noble metal tip is 0.25 mm or more.

2. The spark plug as claimed in claim 1, wherein said inner side face of said ground electrode has a width that is smaller as it advances toward a tip end side, in a portion of the inner side face positioned between a pair of tapered faces, and wherein said molten bond is formed so as to extend from said inner side face to said tapered faces, said molten bond having a curved shape which protrudes outward in a convex shape at a corner formed between said inner side face and each of said tapered faces.

3. The spark plug as claimed in claim 2, wherein said curved shape of said molten bond at the corner formed between said inner side face and each of said tapered faces has a radius of curvature of from 0.3 to 1.0 mm.

4. The spark plug as claimed in claim 2, wherein said molten bond having a curved shape extends to a corner formed among said inner side face, a tip end face, and each of said tapered faces of said ground electrode.

5. The spark plug as claimed in claim 4, wherein said molten bond having a curved shape protrudes outward in a convex shape at said corner formed among said inner side face, a tip end face, and each of said tapered faces of said ground electrode.

6. The spark plug as claimed in claim 1, wherein said noble metal tip protrudes by 0.3 mm or more from said molten bond.

7. The spark plug as claimed in claim 1, wherein said noble metal tip satisfies a relationship of $t \geqq 0.78 \times S$, between a height, t (mm) of said unmelted portion and a horizontal sectional area, S ($mm^2$) of the noble metal tip of the ground electrode.

* * * * *